US009151092B2

(12) United States Patent
Scholz et al.

(10) Patent No.: US 9,151,092 B2
(45) Date of Patent: Oct. 6, 2015

(54) LOCK UNIT HAVING A MULTI-PAWL LOCKING MECHANISM

(75) Inventors: Michael Scholz, Essen (DE); Marek Dragon, Waldbröl (DE)

(73) Assignee: Kiekert AG, Heiligenhaus (DE)

( * ) Notice: Subject to any disclaimer, the term of this patent is extended or adjusted under 35 U.S.C. 154(b) by 610 days.

(21) Appl. No.: 13/119,960

(22) PCT Filed: Nov. 5, 2009

(86) PCT No.: PCT/DE2009/001570

§ 371 (c)(1),
(2), (4) Date: Mar. 19, 2011

(87) PCT Pub. No.: WO2010/057461

PCT Pub. Date: May 27, 2010

(65) Prior Publication Data

US 2011/0210565 A1 Sep. 1, 2011

(30) Foreign Application Priority Data

Nov. 19, 2008 (DE) ..... 10 2008 057 961

(51) Int. Cl.
*E05C 3/06* (2006.01)
*E05B 85/26* (2014.01)

(52) U.S. Cl.
CPC ..... *E05B 85/26* (2013.01); *Y10T 292/108* (2015.04)

(58) Field of Classification Search
USPC ..... 292/200, 216, 201, DIG. 23
See application file for complete search history.

(56) References Cited

U.S. PATENT DOCUMENTS

| | | | | |
|---|---|---|---|---|
| 6,540,271 | B1 * | 4/2003 | Kalsi | 292/216 |
| 6,601,883 | B1 * | 8/2003 | Kalsi | 292/216 |
| 8,480,138 | B2 * | 7/2013 | Bendel et al. | 292/201 |
| 2003/0218340 | A1 * | 11/2003 | Coleman et al. | 292/169.11 |
| 2008/0136196 | A1 * | 6/2008 | Pecoul et al. | 292/215 |
| 2008/0224482 | A1 * | 9/2008 | Cumbo et al. | 292/216 |
| 2010/0052341 | A1 * | 3/2010 | Taurasi et al. | 292/304 |

FOREIGN PATENT DOCUMENTS

| | | | |
|---|---|---|---|
| DE | 201 04 625 | U1 | 9/2002 |
| DE | 101 14 065 | A1 | 11/2002 |
| EP | 1241305 | A1 * | 9/2002 |
| WO | 2008/061491 | A1 | 5/2008 |

* cited by examiner

*Primary Examiner* — Mark Williams
(74) *Attorney, Agent, or Firm* — Renner, Otto, Biosselle & Sklar, LLP

(57) ABSTRACT

A lock unit (1) comprising at least one catch (2), a first pawl (3) with a pawl rotation axis (4), and a blocking lever (5), wherein in a locked state of the lock unit (1), the catch (2) transfers a moment of rotation onto the first pawl (3) and the first pawl (3) is held in place by means of the blocking lever (5), wherein a second pawl (6) is pivotably arranged on the pawl rotation axis (4) and is engageable with the blocking lever (5) and the catch (2), and the first pawl (3) has a curved first blocking surface (12) for the primary position (13) of the catch (2).

20 Claims, 5 Drawing Sheets

LOCK UNIT HAVING A MULTI-PAWL LOCKING MECHANISM

CROSS-REFERENCE TO RELATED APPLICATIONS

This is a National Stage Application of International Patent Application No. PCT/DE2009/001570, with an international filing date of Nov. 5, 2009, which is based on German Patent Application No. 10 2008 057 961.0, filed Nov. 19, 2008.

BACKGROUND OF THE INVENTION

1. Filed of the Invention

The present invention relates to a lock unit comprising at least one catch, a first pawl with a pawl axis of rotation, and a blocking lever, wherein in a locked state, the catch transfers a moment of rotation onto the first pawl and the first pawl is held in place by means of the blocking lever. Such lock units are used in motor vehicles, in particular, for locking doors, hatches, or the like.

2. Brief Description of the Related Art

In the lock units described herein, the relative position between the catch and pawl is usually not such that the force exerted by the catch is transferred through an axis of rotation of the pawl and, thus, not such that the catch can be arrested alone by means of the pawl. Instead, here, in particular, in order to provide a very quiet operation of the lock unit, the pawl is formed or arranged such that the force exerted by the catch transfers a torque on the pawl directly, which promotes the release of the catch. In this way, the catch (alone) transfers an opening moment onto the first pawl such that the catch can be easily moved into the open position as a result of the spring preloading of the catch and/or as a result of a force transferred to the catch coming (indirectly) from a door seal.

To ensure solid locking, a blocking lever is provided, which arrests the first pawl in the locked position (closed position) such that particular position shifts with respect to the locking mechanism (for example, by pressing together the door seals), driving operation, etc., do not cause an (accidental) opening of the lock unit and a loss of contact between the catch and the pawl. In this way, the self-opening mechanism of the locking mechanism is blocked.

Such a lock unit is described, for example, in WO 2008/061491 A1. There, a lock unit is described, which also has a second pawl, which is mounted on the axis of rotation of the first pawl and is engageable with the blocking lever and the catch. In particular, it is explained there, in connection with the drawings, how the contact force vectors of the components of the locking mechanism are formed in the respective latching positions or movements. This lock unit has already proven to be highly effective. However, further improvements are necessary.

In particular, it is a task of the present invention to provide a lock unit that is dependable with respect to the complex movements of all components under all operating conditions, that fulfills the requirement for limited required installation space, which is quieter, and which provides for a more comfortable operation.

BRIEF DESCRIPTION OF THE INVENTION

These tasks are achieved with a locking device having the features as in claim 1. Advantageous embodiments of the lock unit and the preferred field of operation are given in the dependent claims. It should be noted that in the claims, individually listed features can be combined in any technologically sensible way and to show further embodiments of the invention. In addition, the description, particularly in connection with the drawings, explains additional benefits and further embodiments of the invention.

The inventive lock unit comprises at least one catch, a first pawl with a pawl axis of rotation, and a blocking lever, wherein in a locked state of the lock unit, the catch transfers a moment of rotation onto the first pawl and the first pawl is held in place by means of the blocking lever. A second pawl is also provided, which is mounted rotatably on the pawl axis of rotation and which is engageable with the blocking lever and the catch. The first pawl has a curved first blocking surface for the primary position of the catch.

The lock unit is, in particular, a lock for a vehicle door, but may also be used for other doors, hatches, etc. The function of the so-called locking mechanism comprising a catch and a pawl is generally known with respect to motor vehicle locks, so that it needs to be mentioned here only in passing that a catch bolt (also known as a locking bolt) is received by means of a (spring-loaded) catch and is arrested in a locked condition (closed position). For the purpose of blocking the rotational movement of the catch, the catch comprises at its outer circumference a so-called primary position, with which the first pawl engages. To accomplish this, the first pawl is pivoted and comes into contact with the catch in a contact area, in which the pawl and the catch sit closely against one another. The first pawl and second pawl are arranged pivotably on a common axis of rotation. Since the pawls regularly interact with the catch at different time intervals, the possibility exists for the relative motion of the pawls with respect to one another. The pivoting movements of the pawls are enabled by providing spring elements, dampers, Bowden cables, electric motor drives and the like, in addition to so-called release levers. The pivotal movements of the pawls are regularly limited by limit stops (for example, implemented especially on one of the pawls and/or the blocking lever) and/or other components of the lock unit, whereby the pivoting range is advantageously kept small.

Moreover, the first pawl has a curved first blocking surface for the primary position of the catch. It should be emphasized that the first blocking surface has such a curved contour that the catch, which normally has a substantially flat blocking surface, forms a substantially strip-shaped or even linear contact area with the first blocking surface of the first pawl. To this end, the first blocking surface may be convex. The reduction of the contact area between the first pawl and the first blocking surface (primary position) of the catch results in a quieter contact, wherein, e.g., an intended deceleration of the relative motion of both components during their engagement can be achieved through a variation of the curvature of the first blocking surface.

Advantageously, the blocking lever comprises: at least a first actuating arm for the first pawl, a second actuating arm for the second pawl, and a cantilever arm for at least a reset element. The multi-pawl locking mechanism interacts particularly in the respective locking positions of the catch and/or during the subsequent movements with the blocking lever. The blocking lever is implemented as a complex component, which comprises actuating arms, which arms are spatially separated from one another, for actuating the pawls, which pawls are stacked one above the other, wherein the actuating arms comprise contact regions for actuating the first pawl and for actuating the second pawl, which regions are separated from one another. Where appropriate, the contact regions are in different planes perpendicular to the pawl axis of rotation. The provision of separate actuating arms for the first pawl and the second pawl allows the strike faces of the pawls to be placed further apart from each other. In this way, particularly small pivoting angles of the pawls and/or of the blocking lever and low actuation forces can be implemented. This allows the pawls themselves to be relatively small so that very thin components can be used. In addition to the two actuating arms, the blocking lever has also an additional cantilever arm for at least one reset element. The reset element regularly transfers a pivoting torque and/or a force on the cantilever arm so that a safe and secure contact is realized between the blocking lever and the first pawl, the second pawl, and/or another lock component. Consequently, this externally engaging reset element is used in order to provide stability during quick movements when opening and closing the lock unit, wherein the impact noises, particularly due to vibrations, etc., are avoided. The provision of a separate cantilever arm supports the space-saving arrangement of the reset element and, optionally, a simple replacement of the reset element in the case of wear. In addition, the reset element can have smaller dimensions due to its large distance from the axis of rotation of the blocking lever, which also saves installation space and allows for its removal in space.

In this context, the blocking lever advantageously has a pivot axis, with respect to which the cantilever arm is disposed opposite to the first actuating arm and the second actuating arm. In other words, the two actuating arms are positioned on one side of the axis of rotation of the blocking lever and the cantilever arm is positioned on the other side of the axis of rotation of the blocking lever. It is particularly preferred that the first actuating arm for the first pawl and the cantilever arm are oriented such that an imaginary line connecting the two runs approximately through the rotational axis of the blocking lever. The second actuating arm is formed in this case, for example, in the manner of a side offshoot protruding from the first actuating arm. This results in the advantage that in the closed position of the lock unit, where the first actuating arm is in contact with the first pawl, a contact force of the first pawl in the direction of the axis of rotation of the blocking lever is produced and, due to a large distance between a contact area with the second actuating arm toward the second pawl, low release forces are produced for the relative motion of the first actuating arm of the blocking lever and the first pawl. This allows for significant improvement in the operating comfort and noise level.

Additionally, the blocking lever with the cantilever arm may be contacted with the reset element only part of the time. This means, in particular, that the reset element is stationarily positioned in the pivoting range of the blocking lever or its actuating arm and/or its cantilever arm. Then, the reset element interacts with the blocking lever, for example, only in specific positions, such as the closed position of the lock unit and/or the first position and/or the open position. For such reset elements, e.g., spring elements, damping elements, etc., are used. Basically, it is also possible that the blocking lever contacts (in succession) many reset elements during its entire pivoting range, wherein one reset element can act permanently and another one can act only part of the time. The reset elements may also be different in nature (elastic, damping).

Although the combination of the curved first blocking surface with the above, more complex structure of the blocking lever is advantageous in terms of comfortable, quiet operation, the embodiment of the blocking lever described here may be advantageous, regardless of the aspect of the curved blocking surface, in lock units that include several pawls and a self-opening mechanism. These could also be implemented and used independently.

It is also regarded as advantageous that the first pawl has a first blocking surface for the primary position of the catch and a stop surface for the blocking lever, wherein the first blocking surface and the stop surface are distanced differently from the pawl pivot axis. Thus, the invention distinguishes itself in particular from the widespread view that the blocking of the catch (the blocking lever) is implemented opposite the primary position. It is suggested instead that the contact area between the primary position and the first blocking surface is closer to the pawl axis of rotation than the contact area between the stop surface and the blocking lever. It is particularly preferred that the contact area between the stop surface and the blocking lever is arranged at least 10 mm, and possibly even at least 25 mm, radially further to the outside starting from the pawl pivot axis.

According to a further embodiment of the lock unit, the first pawl adjacent to a stop surface for the blocking lever has a recess for the first actuating arm. The recess may, in particular, be formed as an undercut into which the actuating arm plunges, for instance, by means of the reset element. In particular, the attachment can be implemented at the first pawl. This also prevents the blocking lever from striking an area and producing noise during operation of the lock unit and/or in the locking position during operation of the motor vehicle.

The invention has particular application in a motor vehicle that comprises at least one inventive lock unit.

The invention and the technical background are explained in more detail hereinbelow with reference to the figures. It should be noted that the figures show particularly preferred embodiments of the invention, but the invention is not limited to these embodiments.

DETAILED DESCRIPTION OF THE INVENTION

Figure 1:
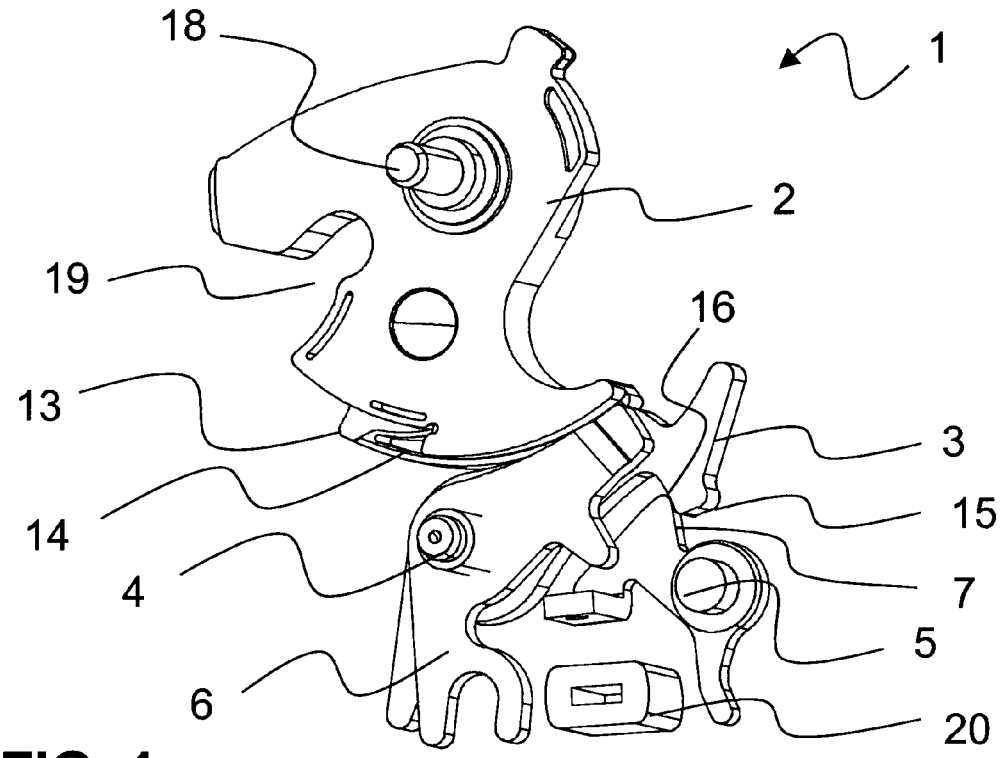
FIG. 1 shows a first embodiment of a locking device in the "open" position.

FIG. 1 shows schematically a perspective view of a multipart locking mechanism of a lock unit 1. The key component of the lock unit 1 is the catch 2, which is rotatably mounted (and spring loaded) about a rotational axis 18. On the left of the figure, shown is the inlet opening 19 for the catch bolt. The catch 2 comprises at the bottom, in different adjacent planes that are perpendicular to the rotational axis 18, a primary position 13 that is disposed close with respect to the inlet opening 19 and a first position that is somewhat further removed.

Near the circumference of the catch 2 are disposed the pawls 3 and 6 while the lock unit 1 is in the open position. Shown here are the first pawl 2 and the second pawl 6 rotatably disposed on the common pawl axis of rotation 4, which are implemented as stamped components. The arrangement of the first pawl 3 and the second pawl 6 in planes that lie one above the other corresponds with the arrangements of the primary position 13 and the first position 14 of the catch 2 in different planes. The first pawl 3 and the second locking pawl 6 extend between the catch 2 and the blocking lever 5.

The blocking lever 5 is also mounted rotatably or pivotally, whereas the first actuating arm 7 of the blocking lever 5 lies sideways next to the stop surface 15 of the first pawl 3 in a recess 16 such that the first pawl 3 can be pivoted freely in the direction of the catch 3 and to some extent (particularly against the force of the reset element) can also be pivoted freely in the opposite direction.

The second pawl 6 and the blocking lever 5 are configured and arranged such that a damper 20 is provided between them or in their pivoting range. The function of the damper 20 will be explained later.

Figure 2:
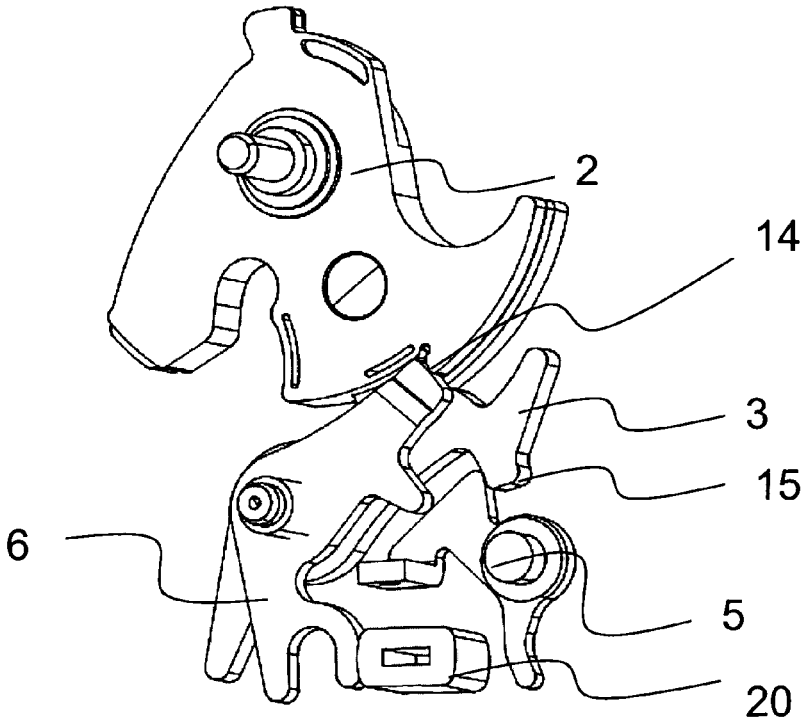
FIG. 2 shows the locking device of FIG. 1 in the "first position"

FIG. 2 shows the catch 2, which was moved counterclockwise until the second pawl 6, which is biased counterclockwise, is pressed against the first position 14. In this phase, the second pawl 6 moves with respect to the first pawl 3 in such a way that the first pawl is pivoted towards the catch. If the closing process cannot be completed at this stage, the catch 2 is nevertheless secured against inadvertent opening in the clockwise direction by the close-fit of the second pawl against the first position 14. In order to prevent inadvertent lifting of the second pawl 6 away from the catch 2, in this phase, the second pawl 6 fits closely against the damper 20. The blocking lever 5 maintains its position, in the same way as the first pawl 3.

Figure 3:
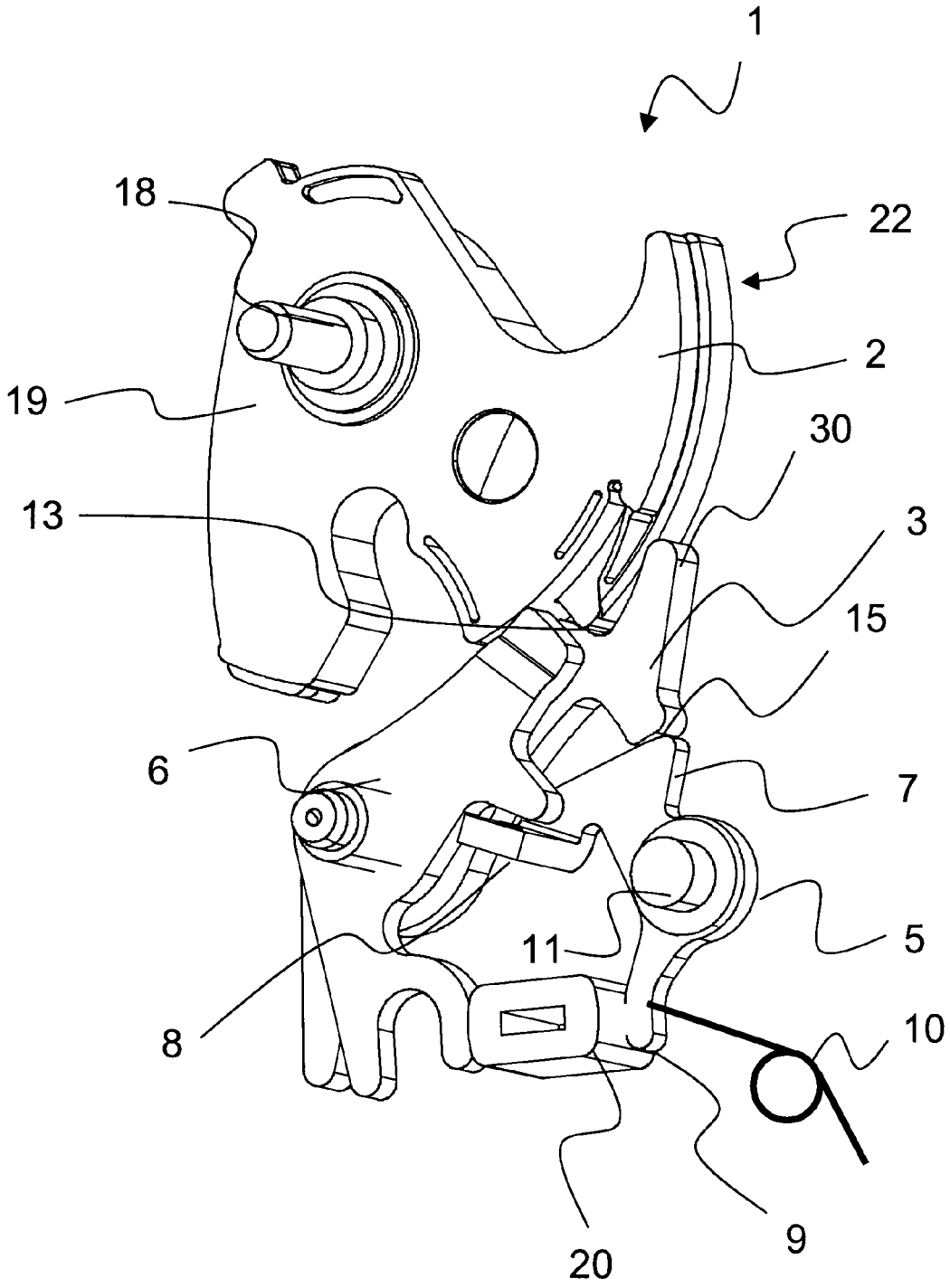
FIG. 3 shows the locking device of FIGS. 1-2 in the closed position (primary position)

FIG. 3 shows the closed position of the lock unit 1. Up to this position, the orientation of the second pawl 6 is essentially unchanged. The catch 2 has, however, rotated further counterclockwise, such that the second pawl 6 follows on the periphery 22 of the catch 2. The same happens with respect to the first pawl 3, wherein the pawl 3 (also biased counterclockwise) falls into the primary position 13, particularly up until the stop 30 (for limiting the rotational angle of the first pawl 30) fits closely against the catch 2. The blocking lever 5 is pivoted equally via the reset element 10 and positions itself with its first actuating arm 7 before the stop surface 15 of the first pawl 3. In this position, the cantilever arm 9 fits closely against the damper 20 such that in the closed position, the second pawl 6 and the blocking lever 5 contact the damper 20.

To trigger the opening mechanism and also to lift the first pawl 3 away from the catch 2, the second pawl 6 is pivoted in the clockwise direction over a fork-like end portion indicated at the bottom, such that the second pawl 6 contacts the second actuating arm 8 of the blocking lever 5, which protrudes into the plane of the second pawl 6, and in this way again removes the first actuating arm 7 from the stop face 15 of the first pawl 3.

Figure 4:
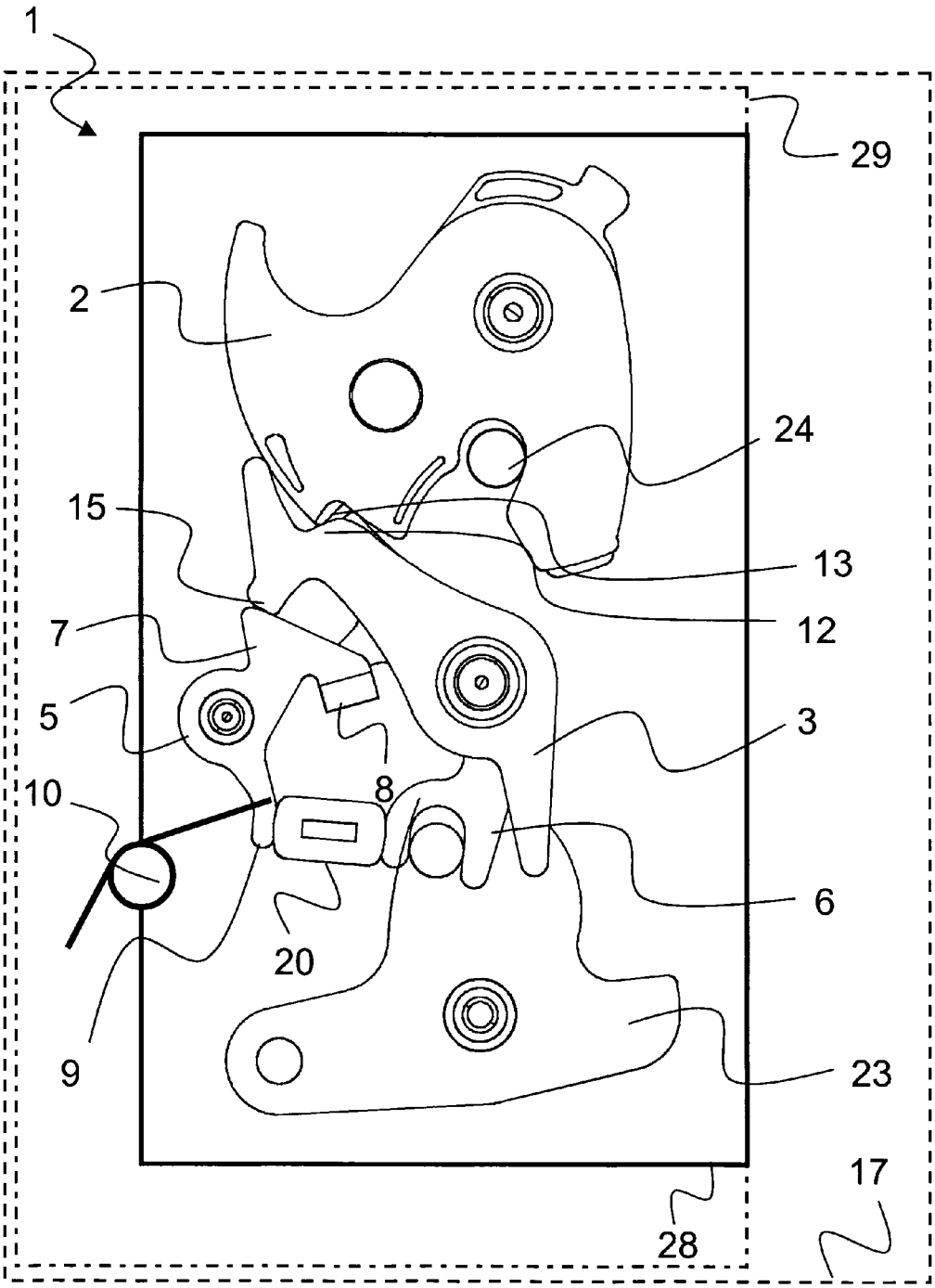
FIG. 4 shows a rear view of the locking device of FIG. 3.

As shown in FIG. 4, when the first actuating arm 7 is removed from the stop face 15 of the first pawl 3, the catch 2 pushes with its primary position on the curved first blocking surface 12, such that the first pawl 3 is pushed away. The catch bolt 24, received in the inlet opening, presses on the catch 2 such that the catch 2 is further pivoted into the open position (as shown here in the counterclockwise direction because of the rear side view).

FIG. 4 shows the release lever 23, which is also pivotally actuatable and acts on the second pawl 6. In addition, the figure shows that the lock unit is arranged in a housing 28 and is attached to a door 29 of a motor vehicle 17.

Figure 5:
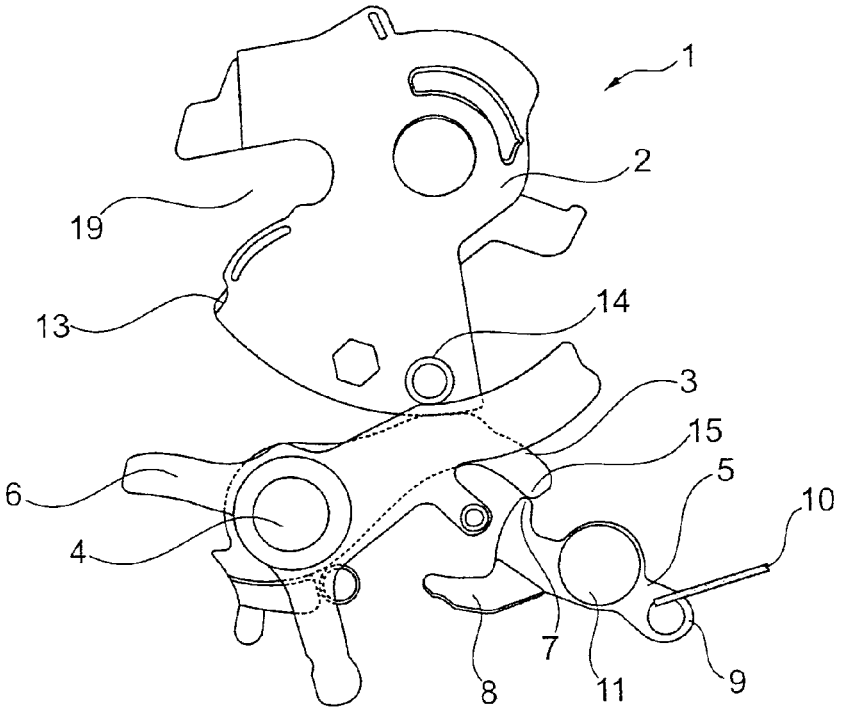
FIG. 5 shows a further embodiment of the lock unit in the "open" position.
Figure 6:
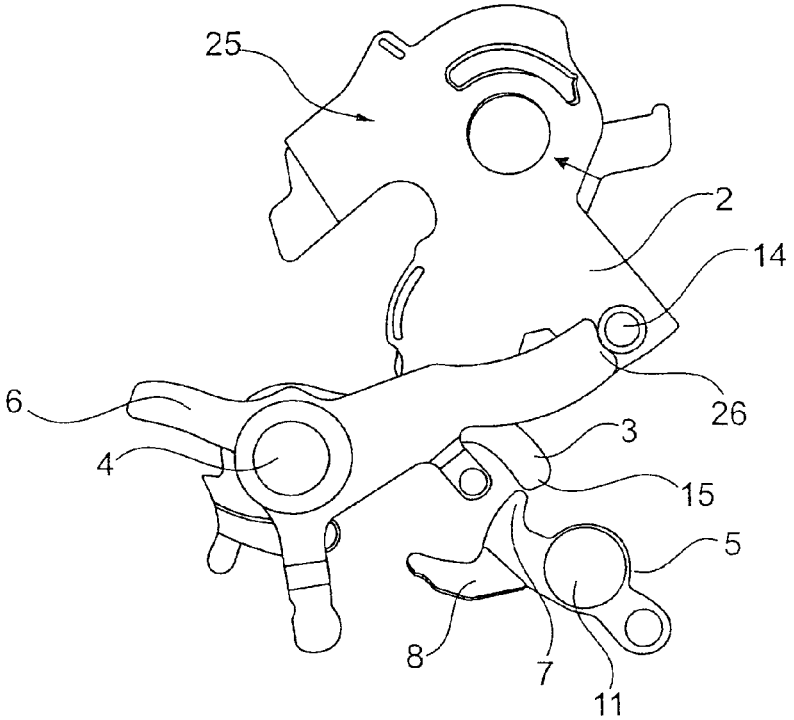
FIG. 6 shows the lock unit of FIG. 5 in the "first position"
Figure 7:
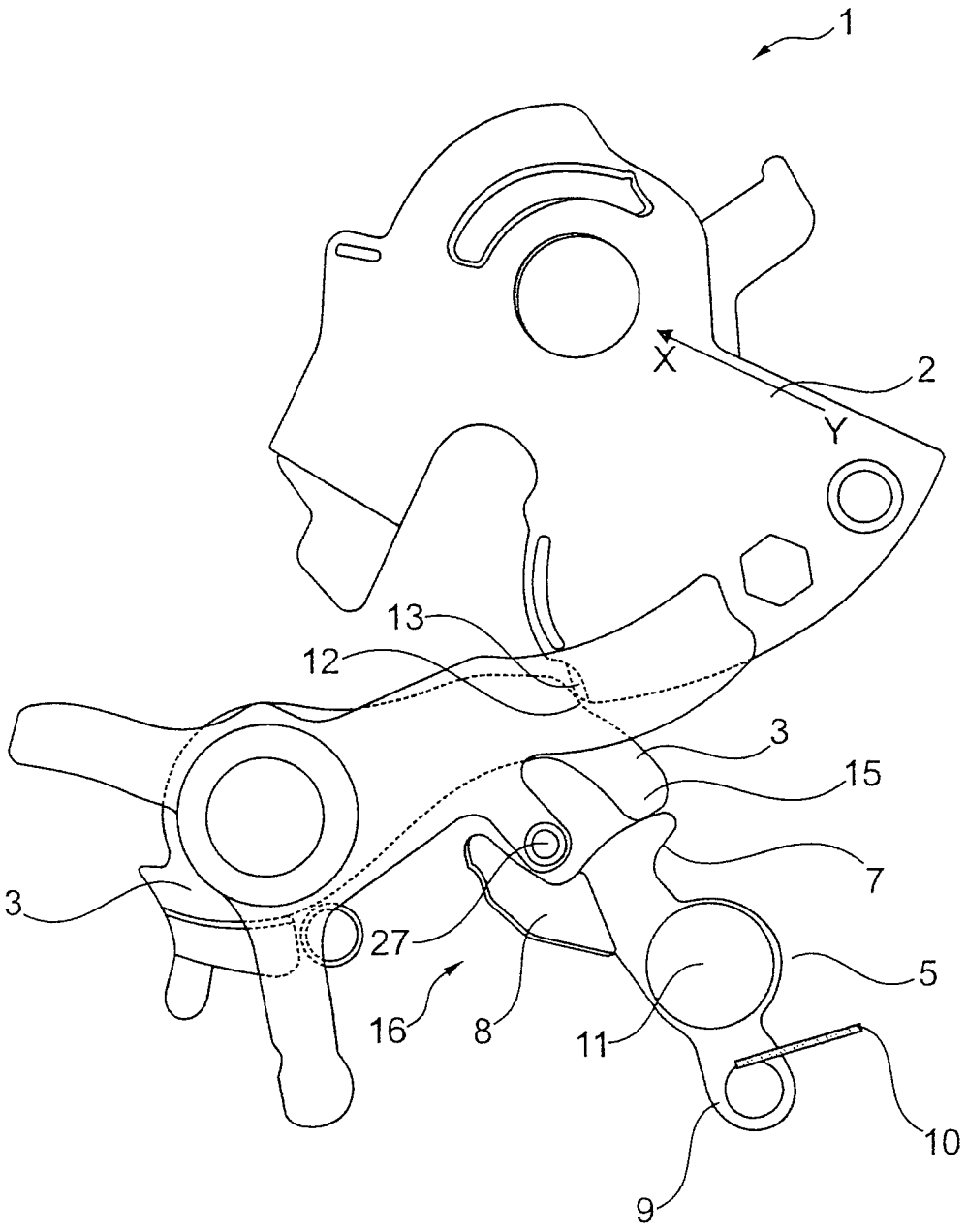
FIG. 7 shows the lock unit of FIGS. 5-6 in the "closed" position (primary position).

Another embodiment of the lock unit 1 is shown in FIGS. 5 to 7. FIG. 5 illustrates again the open position, in which the inlet opening 19 of the catch 2 is ready to receive the catch bolt. The first pawl 3 and the second pawl 6 extend again near the outer circumference of the catch 2. The primary position 13 of catch 2 is arranged on the periphery, while the first position 14 is implemented as a pin on the side 25 of the catch 2. Both pawls 3, 6 are in turn positioned on a common axis of rotation 4. The pawls 3, 6 are formed or arranged such that they extend between the catch 2 and the blocking lever 5. The first actuating arm 7 of the blocking lever 5 also lies in this view, laterally, next to the stop face 15 of the first pawl 3, such that the first pawl 15 can be pivoted to a certain extent.

The blocking lever comprises again: at least a first actuating arm 7 for the first pawl 3, a second actuating arm 8 for the second pawl 6, and a cantilever arm 9 for a reset element 10. The cantilever arm 9 is disposed opposite to the first actuating arm 7 with respect to the axis of rotation 11 of the blocking lever. In this case, the first actuating arm 7 and the cantilever arm are implemented in one plane, and an extension for the interaction of the return component 10 with the cantilever arm 9 can be provided.

FIG. 6 shows the engagement of the second pawl 6 with the first position 14. To this end, the second pawl 6 comprises, at the outer circumference, a recess 26, against which closely lies a pin-like first position 14, after the second pawl 6 is pivoted in the direction of the catch 2. In this position, the blocking lever 5 lies laterally next to the stop surface 15 of the first pawl 3, and the position of the blocking lever 5 has not changed significantly with respect to the open position.

FIG. 7 shows the situation in which the catch 2 securely holds the catch bolt in place (not shown). At this point in time, the first pawl 3 is moved with the curved blocking surface 12, before the primary position 13 of the catch 2 and is secured, by the first actuating arm 7 in front of the stop surface 15 of the first pawl. It should be clearly visible that the contact area of the first blocking surface 12 toward the primary position 13 lies closer to the common axis of rotation 4 of the pawls than to the further-to-the-outside-lying contact area between the stop face 15 of the first pawl 3 and the actuating arm 7 of the blocking lever 5.

In this configuration of the lock unit 1, the opening process takes place via the driver 27 of the second pawl 6, which reaches down into the plane of the blocking lever 5. A similar actuation of the second pawl 6 via a release lever or a release mechanism also initiates the lifting of the blocking lever 5 away from the stop surface 15 via contact with the second actuating arm 8 implemented as a lateral cantilever arm 21 such that the catch 2 can be pushed away by itself, supported by its spring and the catch bolt.

In the embodiments shown in the drawings, quiet closing/opening is achieved with respect to the contact between the first pawl and the catch. The small contact area due to the curved configuration of the first blocking surface is the major contributor to this property. Also, the operating forces are significantly reduced (as above, for example, by about 40%) with respect to conventional locking systems. A further reduction is possible, for example, when the stop surface 15 of the first pawl 3 and/or the first actuating arm 7 of the blocking lever 5 comprise a curved blocking surface. Moreover, it is also possible to further reduce the rotation angles or pivoting angles to less than 40°, in particular to even less than 20°.

REFERENCE LIST

1. Lock unit
2. Catch
3. First pawl
4. Pawl axis of rotation
5. Blocking lever
6. Second pawl
7. First actuating arm
8. Second actuating arm

9. Countilever arm
10. Reset element
11. Blocking lever axis of rotation
12. First blocking area
13. Primary position
14. First position
15. Stop surface
16. Recess
17. Motor vehicle
18. Catch rotation axis
19. Inlet opening
20. Damper
21. Cantilever arm
22. Circumference
23. Operating lever
24. Catch bolt
25. Side
26. Recess
27. Driver
28. Housing
29. Door
30. Stop for limiting the rotational angle

The invention claimed is:

1. A lock unit comprising at least one catch, a first pawl with a pawl rotation axis, and a blocking lever, wherein in a locked state of the lock unit, said catch transfers a moment of rotation onto said first pawl and said first pawl is held in place by means of said blocking lever, and a second pawl that is pivotably arranged on said pawl rotation axis, wherein the second pawl engages said blocking lever to trigger opening of the lock unit; and the second pawl engages said catch at a first position to prevent inadvertent opening of the catch as the catch moves between an open state and the locked state, and said first pawl has a convex curved first blocking surface for engaging a primary position of the catch to prevent movement of the catch when the lock unit is in the locked state.

2. The lock unit of claim 1, further comprising a reset element and wherein said blocking lever comprises:

at least a first actuating arm that engages said first pawl, a second actuating arm that enages said second pawl, and a cantilever arm that engages at least the reset element.

3. The lock unit of claim 2, wherein said blocking lever has a pivot axis, with respect to which said cantilever arm is disposed opposite to said first actuating arm and said second actuating arm.

4. The lock unit of claim 3, wherein said blocking lever with said cantilever arm contacts said reset element only at certain times.

5. The lock unit of claim 4, wherein said first pawl has said first blocking surface for said primary position of said catch and a stop surface for said blocking lever, wherein said first blocking surface and said stop surface are distanced differently from the pawl pivot axis.

6. The lock unit of claim 4, wherein said first pawl neighboring said stop surface for said blocking lever has a recess for said first actuating arm.

7. The lock unit of claim 3, wherein said first pawl has said first blocking surface for said primary position of said catch and a stop surface for said blocking lever, wherein said first blocking surface and said stop surface are distanced differently from the pawl pivot axis.

8. The lock unit of claim 7, wherein said first pawl neighboring said stop surface for said blocking lever has a recess for said first actuating arm.

9. The lock unit of claim 3, wherein said first pawl neighboring said stop surface for said blocking lever has a recess for said first actuating arm.

10. The lock unit of claim 2, wherein said blocking lever with said cantilever arm contacts said reset element only at certain times.

11. The lock unit of claim 10, wherein said first pawl has said first blocking surface for said primary position of said catch and a stop surface for said blocking lever, wherein said first blocking surface and said stop surface are distanced differently from the pawl pivot axis.

12. The lock unit of claim 11, wherein said first pawl neighboring said stop surface for said blocking lever has a recess for said first actuating arm.

13. The lock unit of claim 10, wherein said first pawl neighboring said stop surface for said blocking lever has a recess for said first actuating arm.

14. The lock unit of claim 2, wherein said first pawl has said first blocking surface for said primary position of said catch and a stop surface for said blocking lever, wherein said first blocking surface and said stop surface are distanced differently from the pawl pivot axis.

15. The lock unit of claim 14, wherein said first pawl neighboring said stop surface for said blocking lever has a recess for said first actuating arm.

16. The lock unit of claim 2, wherein said first pawl neighboring said stop surface for said blocking lever has a recess for said first actuating arm.

17. The lock unit of claim 1, wherein said first pawl has said first blocking surface for said primary position of said catch and a stop surface for said blocking lever, wherein said first blocking surface and said stop surface are distanced differently from the pawl pivot axis.

18. The lock unit of claim 17, wherein said first pawl neighboring said stop surface for said blocking lever has a recess for said first actuating arm.

19. The lock unit of claim 1, wherein said first pawl neighboring said stop surface for said blocking lever has a recess for said first actuating arm.

20. A motor vehicle comprising at least a lock unit of claim 1.

* * * * *